US005904774A

United States Patent [19]

Gomariz Perez

[11] Patent Number: 5,904,774

[45] Date of Patent: May 18, 1999

[54] REVARNISHER OF INCISIONS IN EASY-TO-OPEN OVAL AND RECTANGULAR LIDS AND PROCESS OF REVARNISHING

[76] Inventor: Ana Maria Gomariz Perez, Mayor 14, 30500 Molina de Segura, Murcia, Spain

[21] Appl. No.: 08/804,127

[22] Filed: Feb. 20, 1997

[51] Int. Cl.[6] ..... B05B 13/02; B05B 3/00; B21D 51/46

[52] U.S. Cl. ..... 118/324; 118/323; 413/61

[58] Field of Search ..... 118/324, 315, 118/300, 244, 258, 262, 263, 211; 413/58, 61; 198/471.1, 608

[56] References Cited

U.S. PATENT DOCUMENTS 3,712,450 1/1973 Hurst ..... 198/471.1
5,215,587 6/1993 McConnellogue et al. ..... 118/324

*Primary Examiner*—David A. Simmons
*Assistant Examiner*—Calvin Padgett
*Attorney, Agent, or Firm*—Robert M. Schwartz

[57] ABSTRACT

This invention is characterized by the efficient collaboration of magnetic devices and a revarnishing device which allow lids to pass at a high speed and round-the-clock trouble-free operation, on the basis of strips which house magnets which hold the lid while it is being carried and stop for a few tenths of a second opposite a nozzle of an easy-to-open incision revarnishing device spray gun.

3 Claims, 4 Drawing Sheets

FIG. 2
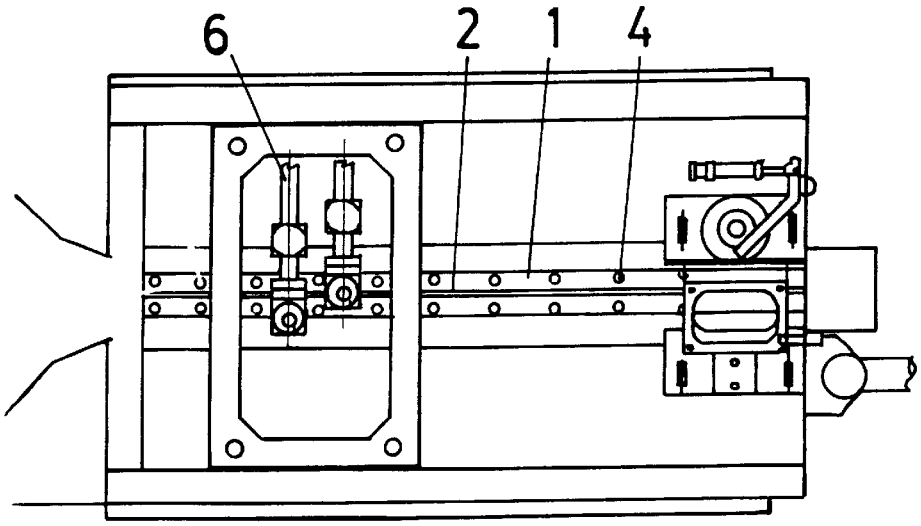
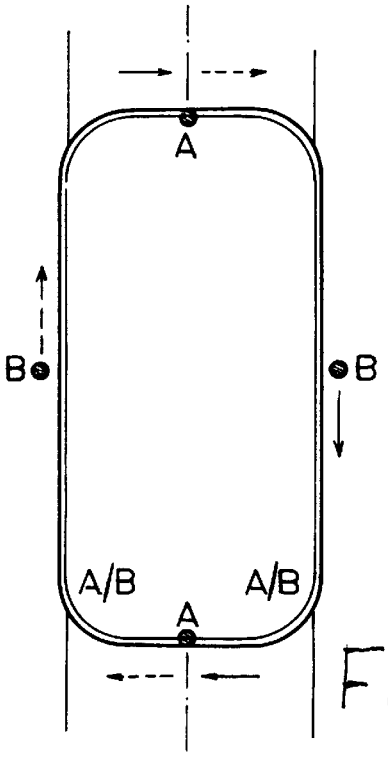
FIG. 2A
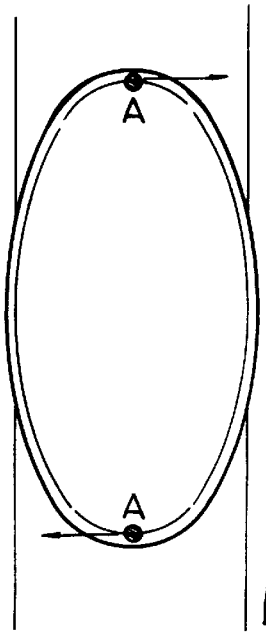
FIG. 2B

REVARNISHER OF INCISIONS IN EASY-TO-OPEN OVAL AND RECTANGULAR LIDS AND PROCESS OF REVARNISHING

BACKGROUND OF THE INVENTION

Varnishing of lids of cans and other easy-to-open type containers is quite well-known, very efficient and usually uses the devices of the type which comprise a mechanism that supplies varnished, means of feeding the cans to a revarnisher device and a drying kiln of the spray line deposited on the incision.

However, the working conditions, and the fact that work is performed continuously to avoid having to turn off the kiln, gives rise to different problems, the greatest of which is the positioning of the cans on the conveyor belt, which is solved by mechanical means, generally by means of a brake and which makes it hard to make the cans pass at a faster speed, unless one runs the risk of deviating the spray jets.

To the knowledge of the applicant, there are no high-speed oval or rectangular lid revarnishers that operate continuously with the collaboration of a very accurate magnetic lid positioning mechanism with another, pistol-based automatic circular revarnishing mechanism, within a conventional revarnished-lid intermittent transport mechanism.

SUMMARY OF THE INVENTION

This invention relates to a revarnisher of incisions in easy-to-open oval and rectangular lids which is of the type that conventionally comprises:

- a tower that magnetically supplies lids, that have been varnished and already have the easy-to-open incision, to
- a link chain having intermittent movement (stop-start) movement, that directs the lids to the revarnisher, and then to
- a tower-type vertical convector furnace, with a rotary lid transporter by means of conveyor buckets attached to a chain and in perfect timed relationship with the conveyor belt stop-start mechanism.

The furnace is used for continues heat-drying the lids on the gun-deposited spray line, and it is also used for consecutive cooling of the lids with the aid of an additional fan incorporated into the body of the furnace and previously located at the exit of the furnace from which the lids are come out.

The improvements object of this machine are related to the means that permits to revarnish with accuracy the incision of the lid, which it is supplied from the tower without varnish and unprotected.

This invention is characterized by the efficient collaboration of magnetic means that hold the lid while it is being transported, consisting of strips assembled parallel and at the sides of the link chain, strips that are provided with lines having a large number of notches on the underside, for conventional housing of magnets, that hold the edges of the lid, affecting the larger sides of the rectangular lid and the most open curved areas of the oval lids, making it possible to hold and convey the lid without it moving, and perfect positioning for a few tenths of a second, opposite the spray gun nozzles.

The lids are guided by ridges laterally located to the strips facilitating rigid and sway-free transport of the lid.

Together with the above mentioned, for such purposes of collaboration, the incision-revarnishing device allows the lids to pass at a high speed and round-the-clock trouble-free operation.

The spray guns of this device are attached, respectively, at the end to the connecting part of two sliding carriages, so that each gun describes a transverse movement to the link chain when it is not moving, and in opposite directions of each gun; the link chain then starts to move without the transverse movement stopping, combining these two movements and, finally, with the transverse movement of the gun stopping so that the gun can act on the larger lateral sections of the lid, in an antagonist figure to the circular incision of the lid, in this case or rectangular type with curved vertices.

Meanwhile, in the oval shape of the lid the type of movements to be combined is of the first two described above.

This assembly is assisted by conventional means for storing and feeding the varnish to the gun, a protective varnishing-station screen to avoid mishandling and sensors connected to automatic stop devices.

BRIEF DESCRIPTION OF THE DRAWINGS

A set of drawings have been enclosed with this descriptive report, of which they form an integral part, in order to supplement this description and make it easier to understand the characteristics of the invention. These drawings, which are provided for the purposes of illustration and are by no means of a limiting nature, show the following:

FIG. 2 is a fragmentary plan view of FIG. 1, schematically and symbolically illustrating FIG. 2A and FIG. 2B the path of each of the spray nozzles on the lid incision.

DESCRIPTION OF A PREFERRED EMBODIMENT

Figure 1:
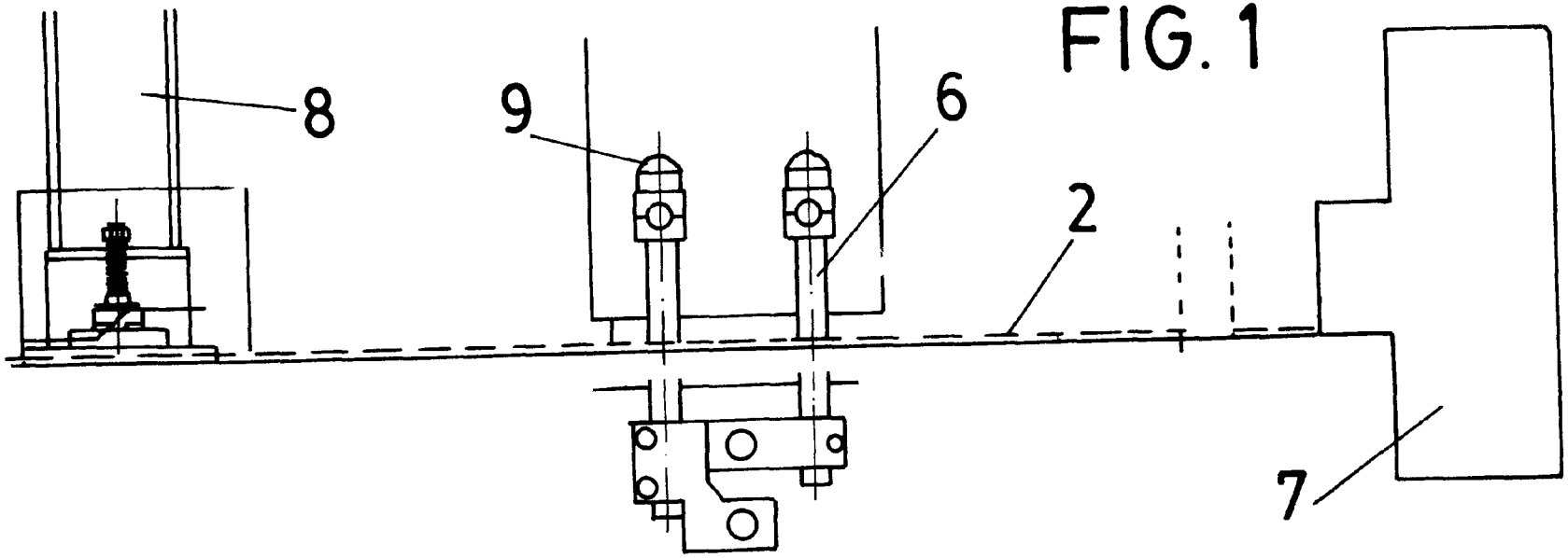
FIG. 1 is an elevation view of the revarnishing area, showing the lid-feeding tower, the lid link chain, the gun support-brackets and the operating devices.
Figure 3:
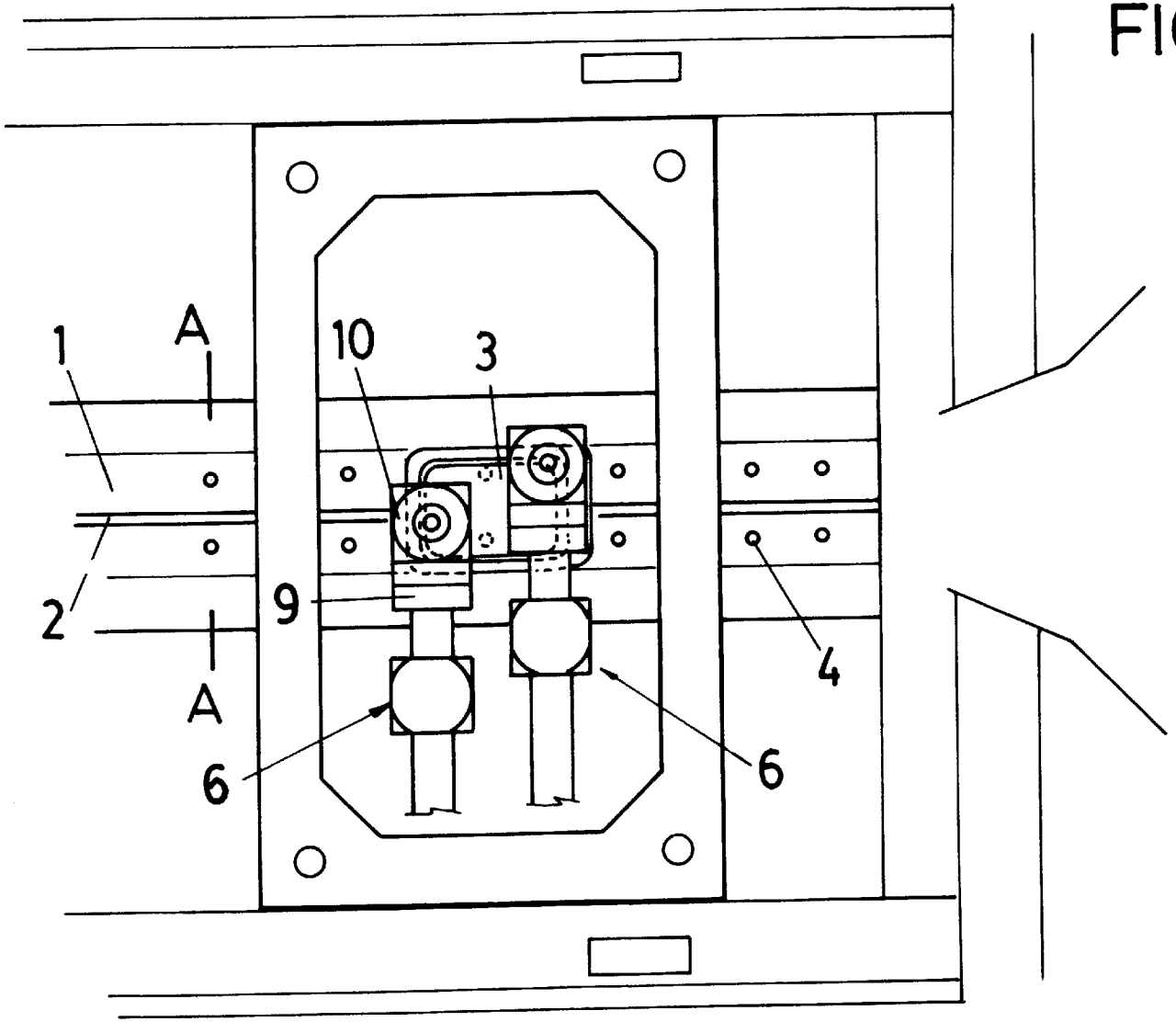
FIG. 3 is a plan view of the layout of the magnetic lid-holding devices, in a fragmentary cross-section.
Figure 4:
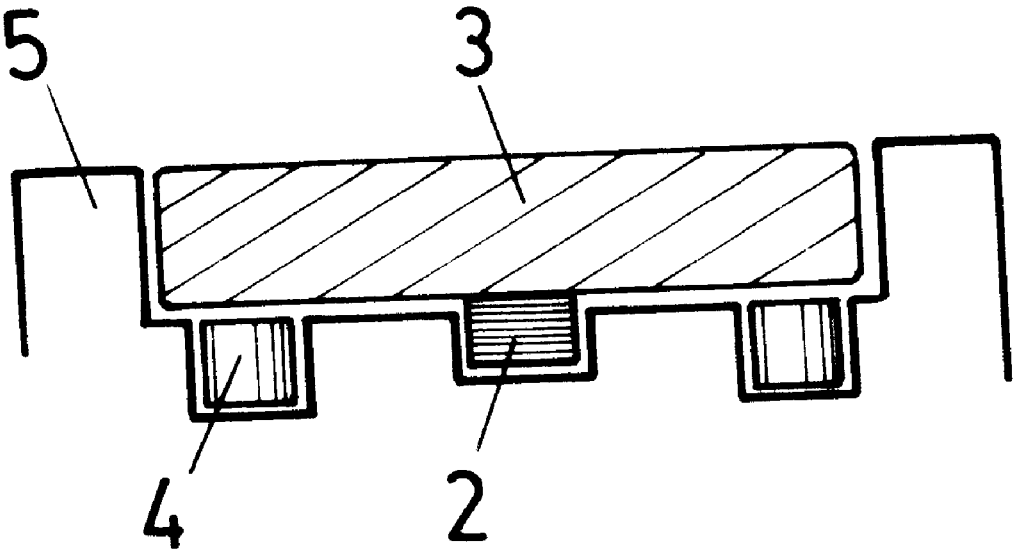
FIG. 4 is a front cross-section view of FIG. 3 over A—A.

As can be seen from the description given above, this invention relates to a revarnisher of incisions in rectangular lids with rounded vertices, and other oval-shaped lids, of the easy-to-open type, of the type of machines which comprise a mechanism (8) that supplies varnished lids having easy-to-open incision, to an intermittently moving link chain (2) that carry on the lids (3), an spray gun (9) with nozzles (10) for revarnishing of the incision, and a vertical convector furnace (7), for heat-drying.

The revarnisher of incisions is characterized by the efficient collaboration of magnetic means that hold the lid while it is being transported.

The improvements of the revarnisher in easy-to-open oval and rectangular lids comprises:

- two strips (1) assembled in parallel form and at the sides of said link chain (2), and provided with a large number of notches (3) on the underside, which house magnets (4) that hold the lid (3) providing a perfect positioning for a few tenths of a second,
- lateral ridges (5) that guide the lid (3), facilitating rigid and sway-free transport of the lid,
- two carriages (6), each one with a connecting part in which said nozzles (10) of the spray guns (9) are joined, describing the oval or rectangular figure with rounded vertices, antagonistic of the incision of each lid.

The revarnishing comprises means for storing and feeding the varnish to the gun, a protective varnishing-station screen to avoid mishandling and sensors connected to automatic stop devices.

With each rectangular lid, the nozzle (10) describes a transverse movement (A) to the still conveyor belt and in opposite directions to each gun (9), then the conveyor belt (A/B) starts to move without the transverse movement stopping and, finally, only the conveyor link chain (2) moves (B).

In the oval shape of the lid (3), there is a combination of the two first movements of the former, the transverse movement (A) to the still conveyor belt and in opposite directions to each gun (9), then the conveyor belt (A/B) starts to move without the transverse movement stopping.

A fuller description is not given because it is understood that any expert in this field will have enough information to understand the scope of the invention and its derived advantages, and to reproduce it.

It is understood that the materials, shape, size and layout of the parts are liable to change as long as no change is made to the essential features of the invention.

The terms used in the description and the sense thereof should always be considered to be of a non-limiting nature.

I claim:

1. Revarnisher of incisions in easy-to-open oval and rectangular lids comprising:

a mechanism that supplies varnished oval and rectangular lids with an easy-to-open oval and rectangular incision without revarnishing, a revarnishing device provided with spray guns with nozzles that revarnish said easy-to-open incision by depositing a spray line on said incision, a convector furnace for heat drying the lids on the spray line deposited on the incision, a link chain with intermittent movement that directs said oval and rectangular lids with an easy-to-open oval and rectangular incision from said mechanism to the spray guns of said revarnishing device and then to said convector furnaces, two strips provided with notches, one strip assembled in parallel form to the other strip at each side of said link chain, magnets housed in said notches generating a magnetic field to hold the lid without moving when the link chain stops and the lid is positioned opposite said spray guns, two ridges that guide the lids on the link chain, said ridges laterally located to said strips, and two carriages, each one having a connecting part in which said nozzles of said spray guns are joined, describing an oval or rectangular incision of each lid.

2. Revarnisher of incisions in easy-to-open oval and rectangular lids according to claim 1, wherein said nozzles are positioned above two consecutive lids and describe a transverse movement to the link chain and in an opposite direction to each other while the link chain remains still, said link chain starts to advance without the transverse movement stopping, said nozzles stop, and said link chain keeps advancing until the corresponding half portion of the incision has been revarnished by each nozzle.

3. Revarnisher of incisions in easy-to-open oval and rectangular lids according to claim 1, wherein said nozzles describe a transverse movement to the link chain and in opposite directions to each other while said link chain advances.

* * * * *